US010643779B2

(12) United States Patent
Shirouzu et al.

(10) Patent No.: US 10,643,779 B2
(45) Date of Patent: May 5, 2020

(54) REACTOR HAVING OUTER PERIPHERAL IRON CORE AND IRON CORE COILS

(71) Applicant: FANUC CORPORATION, Yamanashi (JP)

(72) Inventors: Masatomo Shirouzu, Yamanashi (JP); Kenichi Tsukada, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 132 days.

(21) Appl. No.: 16/019,541

(22) Filed: Jun. 27, 2018

(65) Prior Publication Data

US 2019/0013137 A1 Jan. 10, 2019

(30) Foreign Application Priority Data

Jul. 4, 2017 (JP) ..... 2017-131362

(51) Int. Cl.

| | |
|---|---|
| ***H01F 27/02*** | (2006.01) |
| ***H01F 27/26*** | (2006.01) |
| ***H01F 37/00*** | (2006.01) |
| ***H01F 27/245*** | (2006.01) |
| ***H01F 27/255*** | (2006.01) |
| ***H01F 30/12*** | (2006.01) |
| ***H01F 27/30*** | (2006.01) |
| ***H01F 3/14*** | (2006.01) |
| ***H01F 27/29*** | (2006.01) |
| ***H01F 27/24*** | (2006.01) |

(52) U.S. Cl.

CPC ..... *H01F 27/263* (2013.01); *H01F 3/14* (2013.01); *H01F 27/02* (2013.01); *H01F 27/24* (2013.01); *H01F 27/245* (2013.01); *H01F 27/255* (2013.01); *H01F 27/29* (2013.01); *H01F 27/306* (2013.01); *H01F 30/12* (2013.01); *H01F 37/00* (2013.01)

(58) Field of Classification Search

CPC ..... H01F 27/00–36
USPC ..... 336/83, 90, 92, 178, 212–215, 233–234
See application file for complete search history.

(56) References Cited

U.S. PATENT DOCUMENTS

| | | | | |
|---|---|---|---|---|
| 9,437,361 | B2 * | 9/2016 | Honna | H01F 27/255 |
| 2006/0087393 | A1 | 4/2006 | Dahlgren et al. | |

FOREIGN PATENT DOCUMENTS

| | | | |
|---|---|---|---|
| CN | 201514850 | U | 6/2010 |
| CN | 202454398 | U | 9/2012 |
| CN | 106067367 | A | 11/2016 |
| CN | 205810537 | U | 12/2016 |
| CN | 106816279 | A | 6/2017 |
| JP | H9-69450 | A | 3/1997 |
| JP | 2000-77242 | A | 3/2000 |
| JP | 2000348954 | A | 12/2000 |

(Continued)

*Primary Examiner* — Tuyen T Nguyen
(74) *Attorney, Agent, or Firm* — Hauptman Ham, LLP

(57) ABSTRACT

A reactor includes an outer peripheral iron core composed of a plurality of outer peripheral iron core portions and at least three iron core coils arranged inside the outer peripheral iron core. Each of the at least three iron core coils is composed of an iron core coupled to the respective outer peripheral iron core portion and a coil wound onto the respective iron core. Gaps, which can be magnetically coupled, are formed between adjacent iron cores. The reactor further includes connection parts for connecting the plurality of outer peripheral iron core portions to each other.

9 Claims, 15 Drawing Sheets

(56) References Cited

FOREIGN PATENT DOCUMENTS

| | | | |
|---|---|---|---|
| JP | 2008-210998 | A | 9/2008 |
| JP | 2016-122830 | A | 7/2016 |
| JP | 2017-59805 | A | 3/2017 |

* cited by examiner

π/6

π/3

$\pi/2$ $2\pi/3$ $5\pi/6$ $\pi$

REACTOR HAVING OUTER PERIPHERAL IRON CORE AND IRON CORE COILS

RELATED APPLICATIONS

The present application claims priority of Japanese Application No. 2017-131362, filed Jul. 4, 2017, the disclosure of which is hereby incorporated by reference herein in its entirety.

BACKGROUND OF THE INVENTION

1. Field of the Invention

The present invention relates to a reactor having an outer peripheral iron core and iron core coils.

2. Description of Related Art

Reactors include a plurality of iron core coils, and each iron core coil includes an iron core and a coil wound onto the iron core. Predetermined gaps are formed between the plurality of iron cores. Refer to, for example, Japanese Unexamined Patent Publication (Kokai) No. 2000-77242 and Japanese Unexamined Patent Publication (Kokai) No. 2008-210998.

There are also reactors in which a plurality of iron core coils are arranged inside an annular outer peripheral iron core. In such reactors, the outer peripheral iron core can be divided into a plurality of outer peripheral iron core portions, and the iron cores may be formed integrally with the respective outer peripheral iron core portions.

SUMMARY OF THE INVENTION

However, since the outer peripheral iron core is divided into a plurality of outer peripheral iron core portions, when the reactor is driven, vibrations may be generated due to magnetostriction or the like, and the plurality of outer peripheral iron core portions may become misaligned with each other. In this case, there is a risk that the desired magnetic properties may not be obtained. Furthermore, when the periphery of the outer peripheral iron core is surrounded and connected with a band made from an elastic body, there is a problem in that the size of the reactor increases.

Thus, a reactor in which misalignment of the plurality of outer peripheral iron core portions due to magnetostriction can be prevented without an increase in the size of the reactor is desired.

According to the first aspect of the present disclosure, there is provided a reactor comprising an outer peripheral iron core composed of a plurality of outer peripheral iron core portions, and at least three iron core coils arranged inside the outer peripheral iron core, wherein the at least three iron core coils are composed of iron cores coupled with the respective outer peripheral iron core portions and coils wound onto the respective iron cores, and gaps, which can be magnetically coupled, are formed between one of the at least three iron cores and another iron core adjacent thereto, the reactor further comprising connection parts for connecting the plurality of outer peripheral iron core portions to each other.

In the first aspect, since the plurality of outer peripheral iron core portions are connected by the connection parts, it is possible to prevent the plurality of outer peripheral iron core portions from becoming misaligned due to magnetostriction.

The object, features, and advantages of the present invention, as well as other objects, features and advantages, will be further clarified by the detailed description of the representative embodiments of the present invention shown in the accompanying drawings.

DETAILED DESCRIPTION

Figure 1:
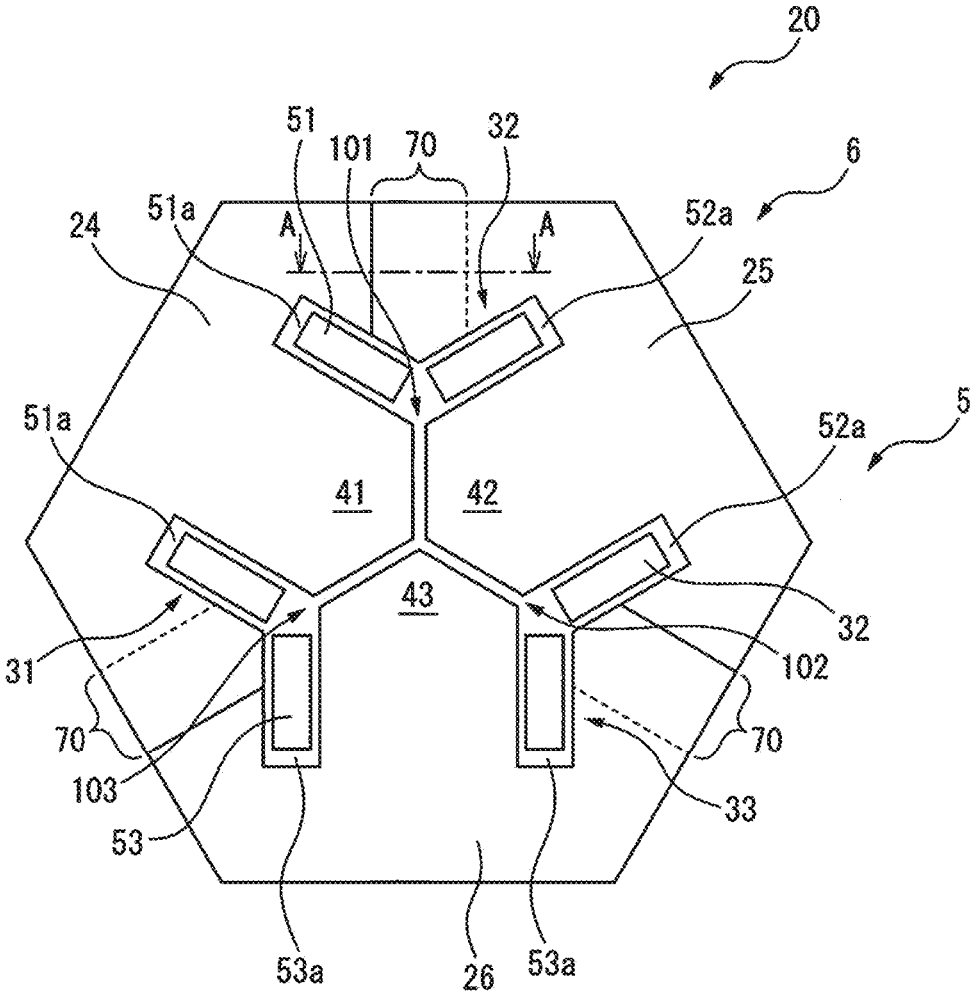
FIG. 1 is a cross-sectional view of the core body of a reactor according to a first embodiment.

The embodiments of the present invention will be described below with reference to the accompanying drawings. In the following drawings, the same components are given the same reference numerals. For ease of understanding, the scales of the drawings have been appropriately modified.

In the following description, a three-phase reactor will be mainly described as an example. However, the present disclosure is not limited in application to a three-phase reactor but can be broadly applied to any multiphase reactor requiring constant inductance in each phase. Further, the reactor according to the present disclosure is not limited to those provided on the primary side or secondary side of the inverters of industrial robots or machine tools but can be applied to various machines.

FIG. 1 is a cross-sectional view of the core body of a reactor according to a first embodiment. As shown in FIG. 1, a core body 5 of a reactor 6 includes an annular outer peripheral iron core 20 and three iron core coils 31 to 33 arranged inside the outer peripheral core 20. In FIG. 1, the iron core coils 31 to 33 are arranged inside the substantially hexagonal outer peripheral iron core 20. These iron core coils 31 to 33 are arranged at equal intervals in the circumferential direction of the core body 5.

Note that the outer peripheral iron core 20 may have another rotationally-symmetrical shape, such as a circular shape. Furthermore, the number of the iron core coils may be a multiple of three, whereby the reactor 6 can be used as a three-phase reactor. As can be understood from the drawings, the iron core coils 31 to 33 include iron cores 41 to 43 extending in the radial directions of the outer peripheral iron core 20 and coils 51 to 53 wound onto the iron cores 41 to 43, respectively.

The outer peripheral iron core 20 is composed of a plurality of, for example, three, outer peripheral iron core portions 24 to 26 divided in the circumferential direction. The outer peripheral iron core portions 24 to 26 are formed integrally with the iron cores 41 to 43, respectively. The outer peripheral iron core portions 24 to 26 and the iron cores 41 to 43 are formed by stacking a plurality of magnetic plates, such as iron plates, carbon steel plates, electromagnetic steel plates, or the like. When the outer peripheral iron core 20 is composed of a plurality of outer peripheral iron core portions 24 to 26, even if the outer peripheral iron core 20 is large, such an outer peripheral iron core 20 can be easily manufactured. Note that the number of iron cores 41 to 43 and the number of iron core portions 24 to 26 need not necessarily be the same.

The coils 51 to 53 are arranged in coil spaces 51*a* to 53*a* formed between the outer peripheral iron core portions 24 to 26 and the iron cores 41 to 43, respectively. In the coil spaces 51*a* to 53*a*, the inner peripheral surfaces and the outer peripheral surfaces of the coils 51 to 53 are adjacent to the inner walls of the coil spaces 51*a* to 53*a*.

Further, the radially inner ends of the iron cores 41 to 43 are each located near the center of the outer peripheral iron core 20. In the drawing, the radially inner ends of the iron cores 41 to 43 converge toward the center of the outer peripheral iron core 20, and the tip angles thereof are approximately 120 degrees. The radially inner ends of the iron cores 41 to 43 are separated from each other via gaps 101 to 103, which can be magnetically coupled.

In other words, the radially inner end of the iron core 41 is separated from the radially inner ends of the two adjacent iron cores 42 and 43 via gaps 101 and 103. The same is true for the other iron cores 42 and 43. Note that, the sizes of the gaps 101 to 103 are equal to each other.

In the configuration shown in FIG. 1, since the three iron core coils 31 to 33 are surrounded by the outer peripheral iron core 20, the magnetic fields generated by the coils 51 to 53 do not leak to the outside of the outer peripheral core 20. Furthermore, since the gaps 101 to 103 can be provided in the center part at any thickness at a low cost by abutting the outer peripheral iron core portions 24 to 26 against each other, the configuration shown in FIG. 1 is advantageous in terms of design, as compared to conventionally configured reactors.

Further, in the core body 5 of the present disclosure, the difference in the magnetic path lengths is reduced between the phases, as compared to conventionally configured reactors. Thus, in the present disclosure, the imbalance in inductance due to a difference in magnetic path length can be reduced.

Additionally, since the gaps are inevitably provided at locations far from the coils, the leakage of magnetic flux from the gaps makes it difficult to interlink the coils. Furthermore, since the angles between the iron cores of the adjacent iron core coils is less than 180 degrees, spreading of magnetic flux from the vicinity of the gaps is suppressed. As a result of these effects, it is difficult to interlink the coils due to the leakage of flux, and the eddy current losses of the coils due to the leakage of magnetic flux can be suppressed.

Figure 2A:
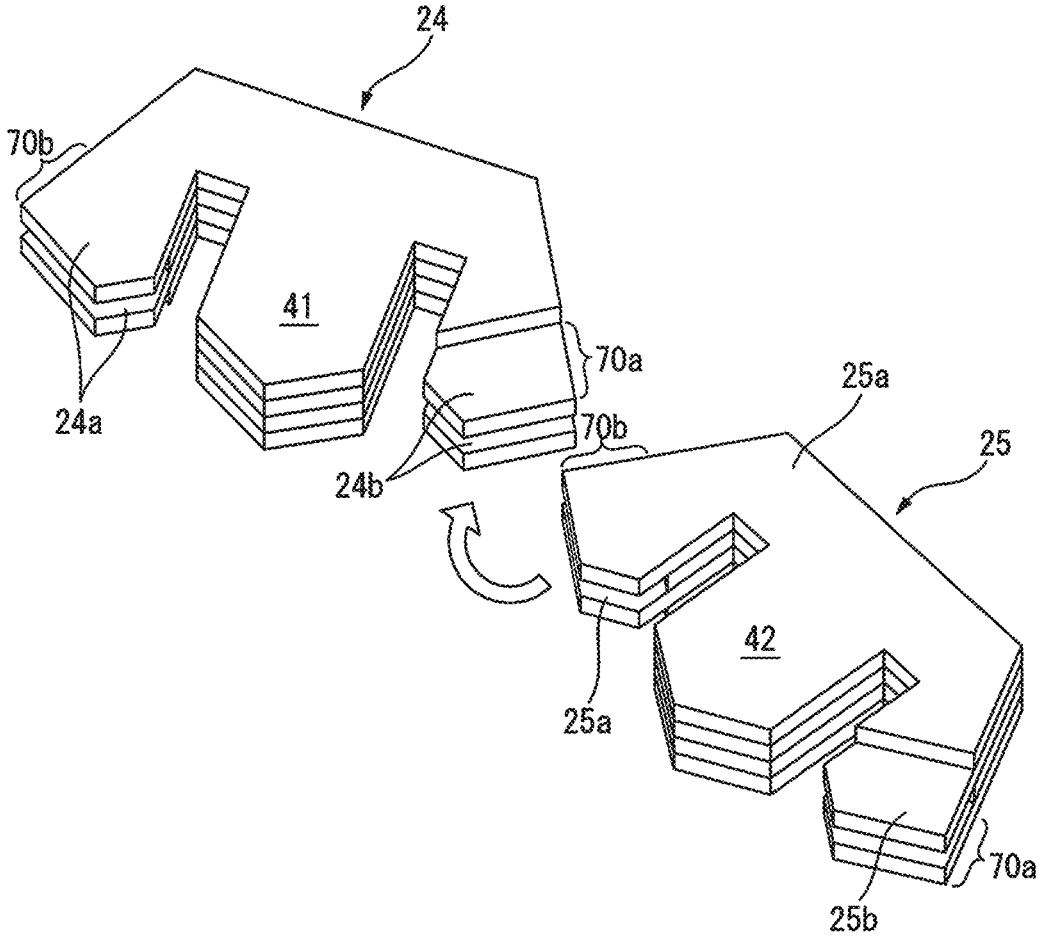
FIG. 2A is a partially exploded perspective view of the core body shown in FIG. 1.
Figure 2B:
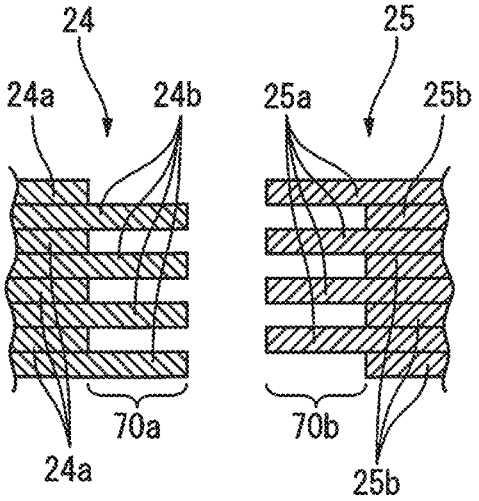
FIG. 2B is a vertical cross-sectional view of the outer peripheral iron core portions shown in FIG. 2A.
Figure 2C:
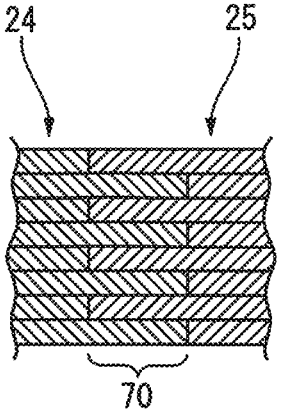
FIG. 2C is a vertical cross-sectional view taken along line A-A of FIG. 1.

FIG. 2A is a partially exploded perspective view of the core body shown in FIG. 1A and FIG. 2B is a vertical cross-sectional view of the outer peripheral iron core portions shown in FIG. 2A. Further, FIG. 2C is a vertical cross-sectional view taken from line A-A of FIG. 1. The connection between the outer peripheral iron core portions 24 and 25 will be described below. Since the connection between the outer peripheral iron core portions 25 and 26 and the connection between the outer peripheral iron core portions 26 and 24 are the same as the connection between the outer peripheral iron core portions 24 and 25, descriptions thereof have been omitted. The same is true for the embodiments described later.

As can be understood from FIG. 2A and FIG. 2B, the outer peripheral iron core portion 24 is formed from magnetic plates 24*a* and 24*b* which have been alternatingly stacked onto each other, and the outer peripheral iron core portion 25 is formed from magnetic plates 25*a* and 25*b*, which have been alternatingly stacked onto each other.

The magnetic plates 24*a* include projecting portions 70*b* projecting toward the outer peripheral iron core portion 26 (not shown in FIG. 2A) at one end in the circumferential direction but do not include projecting portions projecting toward the outer peripheral iron core portion 25 at the other end in the circumferential direction. Similarly, the magnetic plates 24*b* do not include projecting portions projecting toward the other peripheral iron core portion 26 at one end in the circumferential direction but do include projecting portions 70*a* projecting toward the other peripheral iron core portion 25 at the other end in the circumferential direction.

Further, the magnetic plates 25*a* of the outer peripheral iron core portion 25 have the same shape as the magnetic plates 24*a* of the outer peripheral iron core portion 24, and the magnetic plates 25*b* have the same shape as the magnetic plates 24*b* of the outer peripheral iron core portion 24. Though not shown in the drawings, the outer peripheral iron core portion 26 is composed of similar magnetic plates 26*a*, 26*b*.

As shown in FIG. 2A through FIG. 2C, the plurality of projecting portions 70*a* of the outer peripheral iron core portion 24 and the plurality of projecting portions 70*b* of the outer peripheral iron core portion 25 are alternatingly intermeshed with each other to form an intermeshing portion 70 as a connection part. Intermeshing portions 70 are similarly formed at the both ends of the other outer peripheral iron core portion 26. In the present disclosure, the plurality of outer peripheral iron core portions 24 to 26 are connected to each other by means of the above lap jointing or step lap jointing. Note that the projecting portions 70*a*, 70*b* are preferably caulked or adhered to each other, and as a result, the outer peripheral iron core portions 24 to 26 can be firmly held.

Figure 3A:
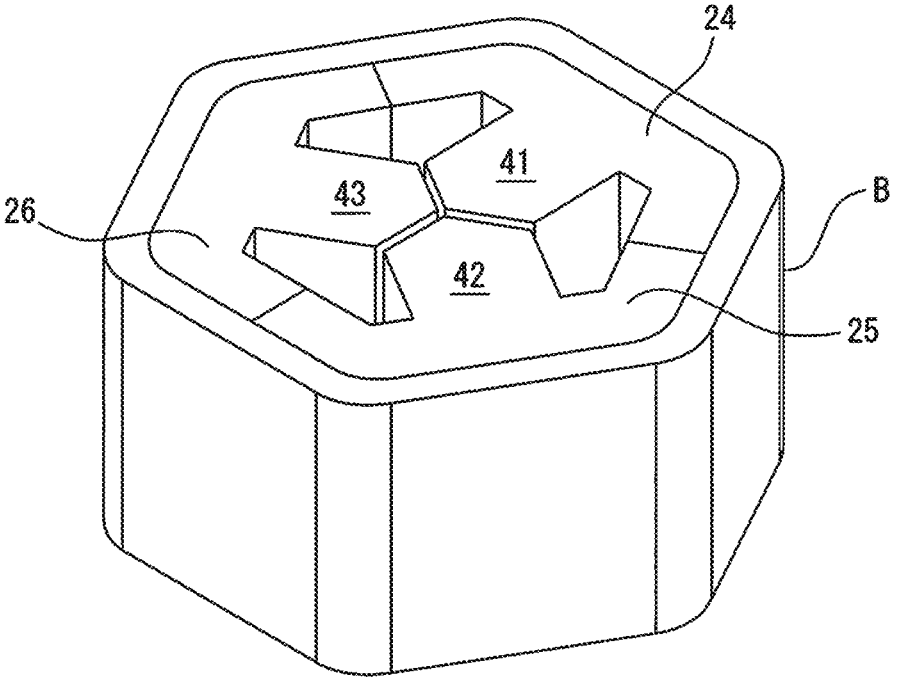
FIG. 3A is a perspective view of a reactor according to the prior art.
Figure 3B:
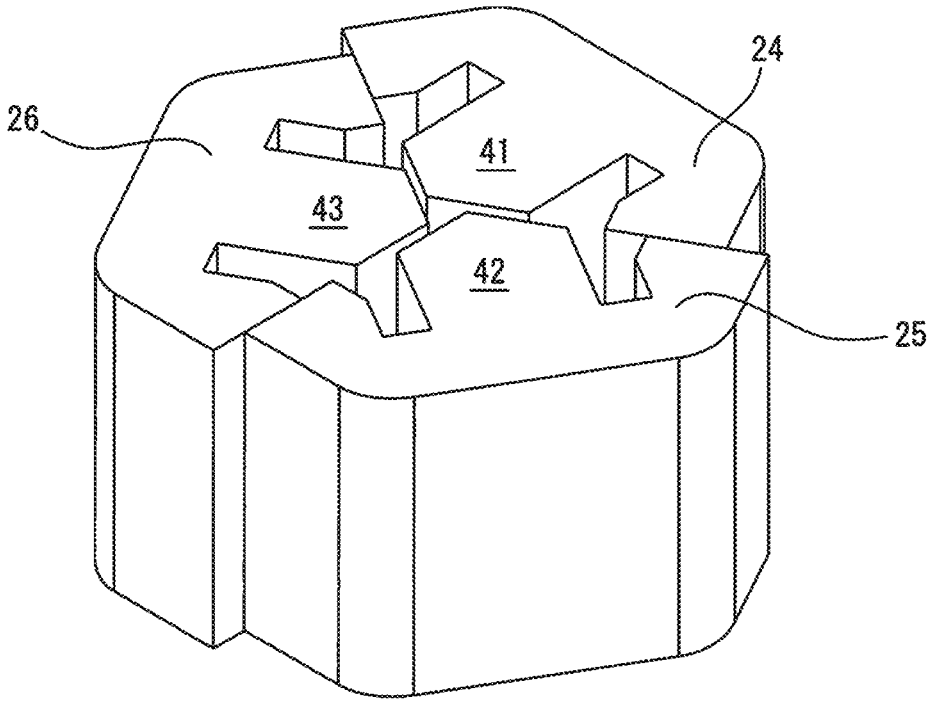
FIG. 3B is a perspective view of another reactor according to the prior art.

FIG. 3B is a perspective view of a reactor according to the prior art. In FIG. 3B, there is a risk that the outer peripheral iron core portions 24 to 26, which are integrally formed with the iron cores 41 to 43, will become misaligned. In order to prevent such misalignment, in FIG. 3A, a band B made from an elastic body is coupled to the periphery of the core body 5. When the connection surfaces between the outer peripheral iron core portions are flat and are not the most convex portions of the outer peripheral iron core, there is a risk that a slight misalignment may occur along the connection surfaces due solely to the winding of the band.

In this connection, in the first embodiment, since the plurality of outer peripheral iron cores 24 to 26 can be connected to each other by the intermeshing portions 70 as connection parts, misalignment of the plurality of outer peripheral iron core portions 24 to 26 due to magnetostriction can be prevented. Furthermore, since additional members or the like are not needed, it is possible to prevent an increase in size of the reactor 6. Further, for the same reason, when connecting the plurality of outer peripheral iron core portions 24 to 26 by the intermeshing portions 70, the influence on the magnetic properties of the reactor 6 at the time of energization can be reduced.

Further, even if minute clearances are formed between, for example, the plurality of magnetic plates 24*a* of the outer peripheral iron core portion 24 and the plurality of magnetic plates 25*a* of the outer peripheral iron core portion 25, other magnetic plates 24*b*, 25*b* are present between the plurality of magnetic plates 24*a* and between the plurality of magnetic plates 25*a*, respectively. Thus, the influence of such minute gaps on the magnetic properties can be minimized.

Figure 4A:
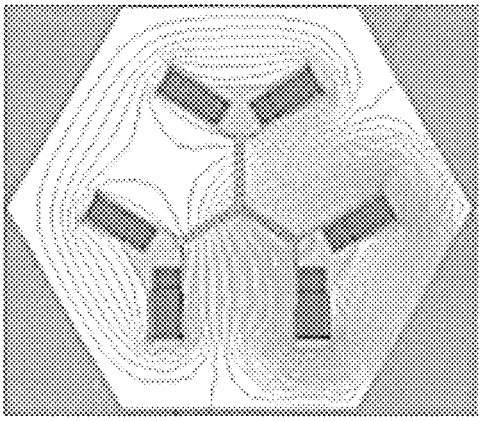
FIG. 4A is a first view showing the magnetic flux density of the reactor according to the first embodiment.
Figure 4B:
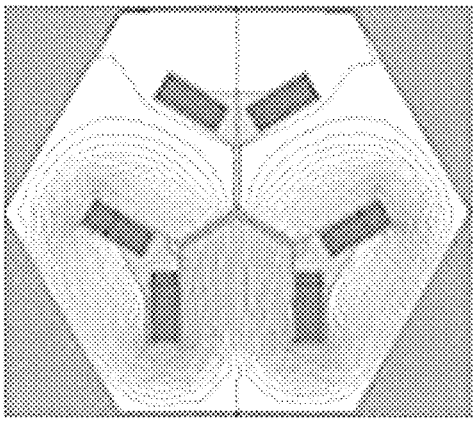
FIG. 4B is a second view showing the magnetic flux density of the reactor according to the first embodiment.
Figure 4C:
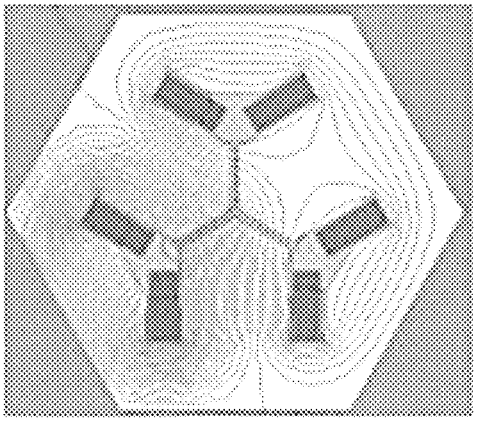
FIG. 4C is a third view showing the magnetic flux density of the reactor according to the first embodiment.
Figure 4D:
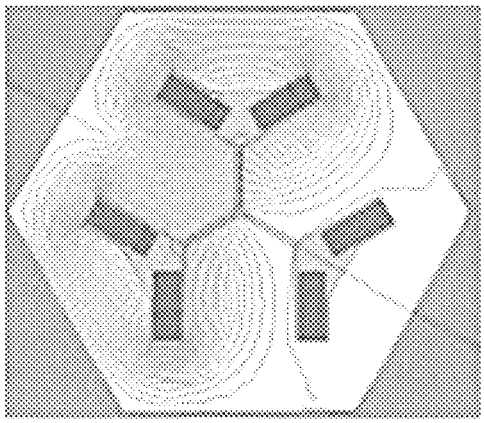
FIG. 4D is a fourth view showing the magnetic flux density of the reactor according to the first embodiment.
Figure 4E:
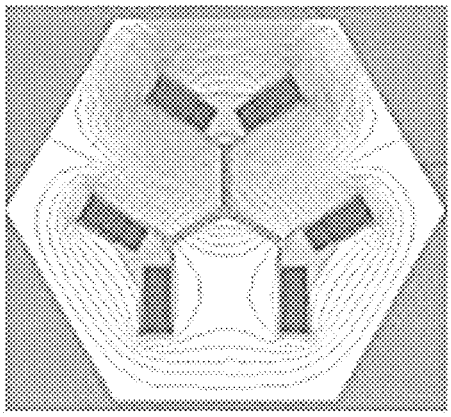
FIG. 4E is a fifth view showing the magnetic flux density of the reactor according to the first embodiment.
Figure 4F:
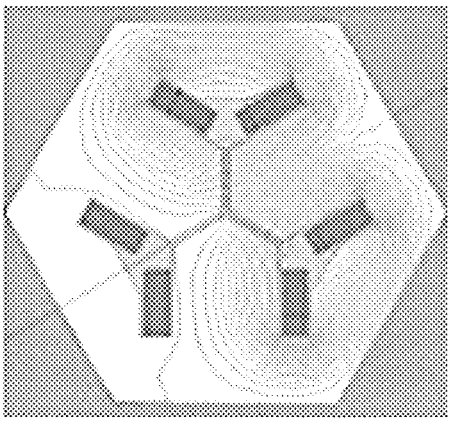
FIG. 4F is a sixth view showing the magnetic flux density of the reactor according to the first embodiment.
Figure 5:
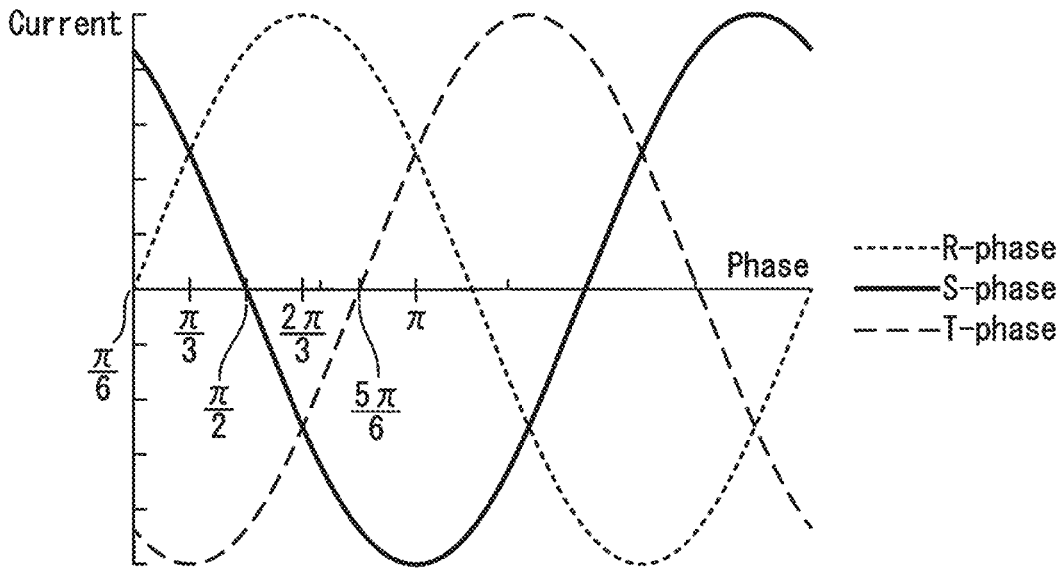
FIG. 5 is a drawing showing the relationship between phase and current.

FIG. 4A through FIG. 4F show the magnetic flux density of the reactor of the first embodiment. FIG. 5 is a drawing showing the time change of current and current phase. Further, FIG. 4A is an end view of the outer peripheral iron core according to the first embodiment. In FIG. 5, the iron cores 41 to 43 of the core body 5 of FIG. 1A are set as the R-phase, S-phase, and T-phase, respectively. Further, in FIG. 5, the current of the R-phase is indicated by the dotted line, the current of the S-phase is indicated by the solid line, and the current of the T-phase is indicated by the dashed line.

In FIG. 5, when the electrical angle is $\pi/6$, the magnetic flux density shown in FIG. 4A is obtained. Likewise, when the electrical angle is $\pi/3$, the magnetic flux density shown in FIG. 4B is obtained. When the electrical angle is $\pi/2$, the magnetic flux density shown in FIG. 4C is obtained. When the electrical angle is $2\pi/3$, the magnetic flux density shown in FIG. 4D is obtained. When the electrical angle is $5\pi/6$, the magnetic flux density shown in FIG. 4E is obtained. When the electrical angle is n, the magnetic flux density shown in FIG. 4F is obtained.

As can be understood with reference to FIG. 4A through FIG. 4F, the magnetic flux densities in the regions of the connection surfaces between the outer peripheral iron core portions 24 to 26 are lower than the magnetic flux density in the remaining portions of the outer peripheral iron core 20. The reason for this is that the widths of the iron cores near the connection surfaces through which the magnetic flux passes are designed to be wider than the other portions of the outer peripheral iron core. Therefore, as shown in FIG. 1, it is preferable to provide connection parts 70 in the areas of the connection surfaces between the outer peripheral iron core portions 24 to 26, which have been designed based on such a concept. In such a case, influence on the magnetic properties of the reactor 6 can be reduced and the outer peripheral iron core portions 24 to 26 can be connected to each other. Further, disassembly and reassembly of the reactor is easy.

Figure 6:
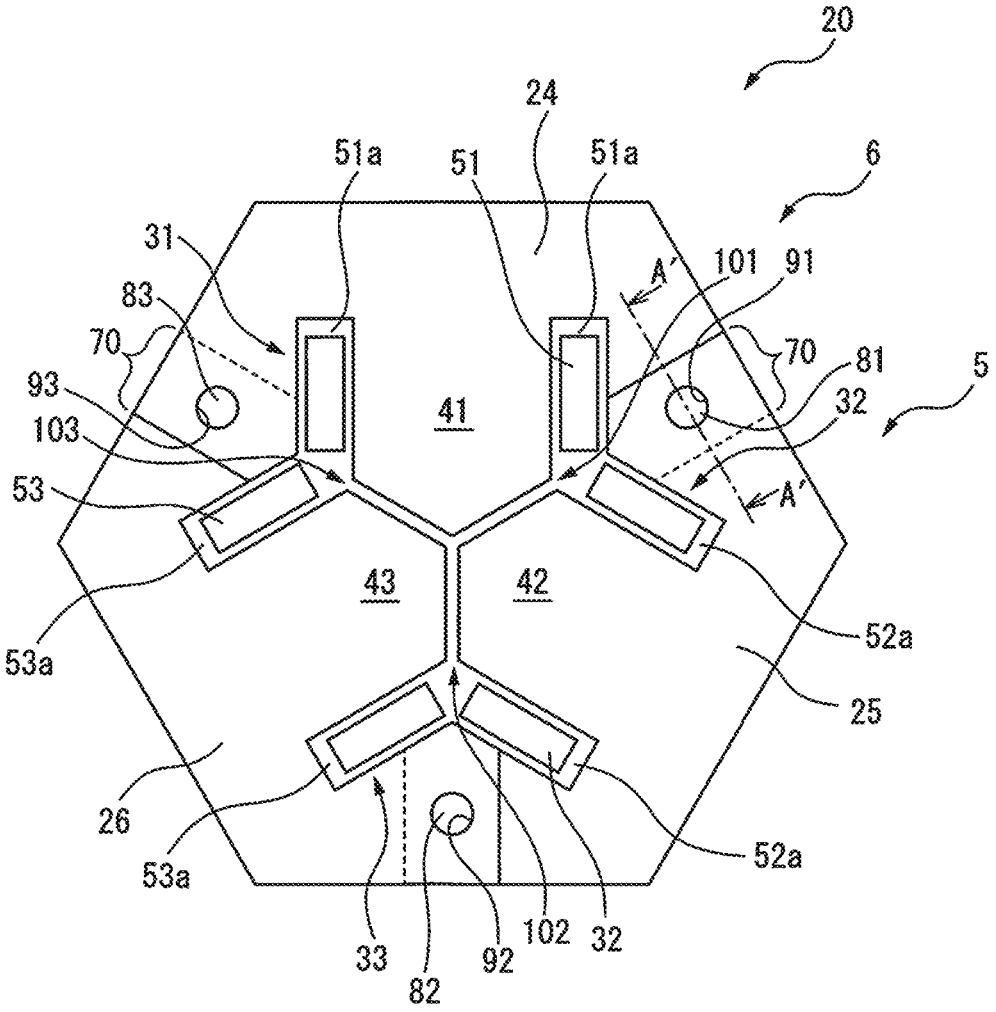
FIG. 6 is a cross-sectional view of the core body of a reactor according to a second embodiment.

FIG. 6 is a cross-sectional view of the core body of a reactor according to a second embodiment. In the core body 5 shown in FIG. 6, connection parts 70 are similarly arranged between the outer peripheral iron core portions 24 to 26. In the second embodiment, the connection parts 70 include through-holes 91 to 93 formed in the intermeshing portions 70 and connection members 81 to 83 which are inserted into and fitted in the through-holes 91 to 93, respectively.

Figure 7A:
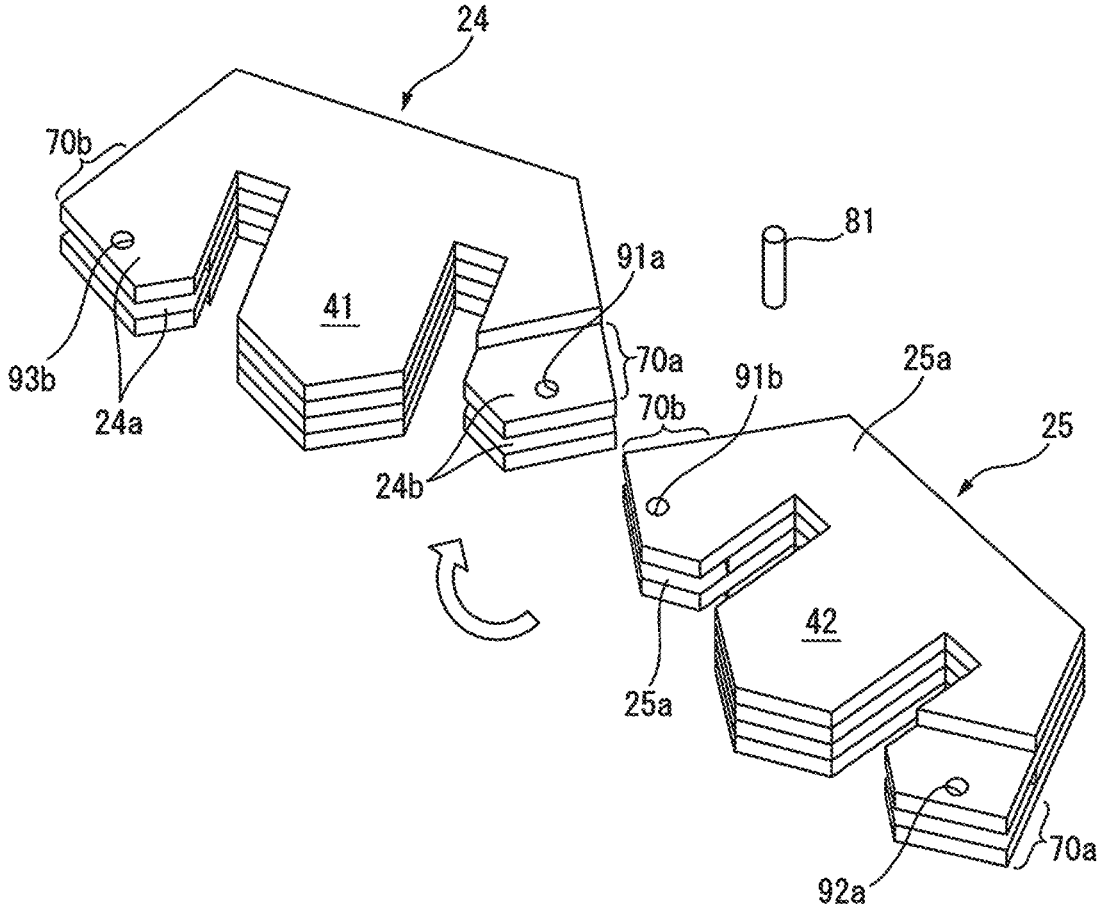
FIG. 7A is a partially exploded perspective view of the core body shown in FIG. 6.
Figure 7B:
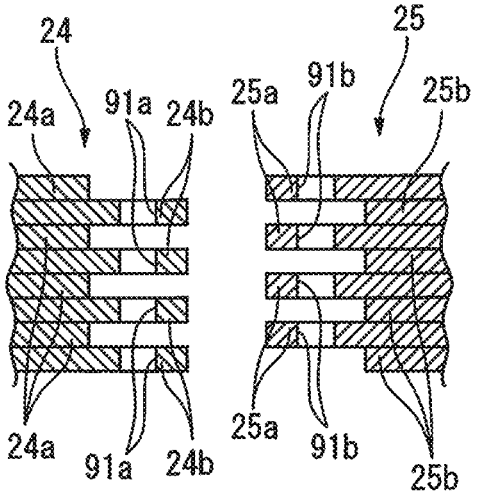
FIG. 7B is a vertical cross-sectional view of the outer peripheral iron core portions shown in FIG. 7A.

FIG. 7A is a partially exploded perspective view of the core body shown in FIG. 6 and FIG. 7B is a vertical cross-sectional view of the outer peripheral iron core portions shown in FIG. 7A. As shown in FIG. 7A, the through-hole 93*b* is formed in the projecting portions 70*b* of the magnetic plates 24*a* of the outer peripheral iron core portion 24 and the through-hole 91*a* is formed in the projecting portions 70*a* of the magnetic plates 24*b*. Likewise, the through-hole 91*b* is formed in the projecting portions 70*b* of the magnetic plates 25*a* of the outer peripheral iron core portion 25 and the through-hole 92*a* is formed in the projecting portions 70*a* of the magnetic plates 25*b*. The sizes of the through-holes 91*a*, 91*b*, 92*a*, and 93*b* are equal to each other.

Figure 7C:
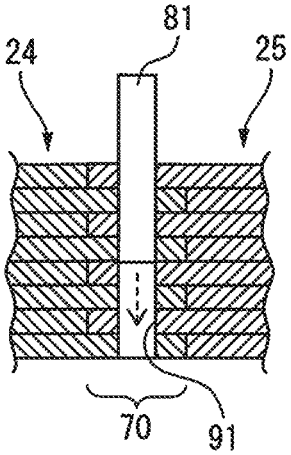
FIG. 7C is a vertical cross-sectional view taken along line A'-A' shown in FIG. 6.

As shown in FIG. 7C, which is a vertical cross-sectional view taken along line A'-A' of FIG. 6, by forming the intermeshing portion 70, the through-hole 91 is formed from the through-holes 91*a* and 91*b*. The connection member 81 is inserted into and fitted in the through-hole 91. As a result, the plurality of outer peripheral iron core portions can be firmly fastened. Note that, in the second embodiment as well, it can be understood that the same effects as described above can be obtained. Furthermore, the through-holes may have shapes different than those shown in FIG. 6.

Figure 8A:
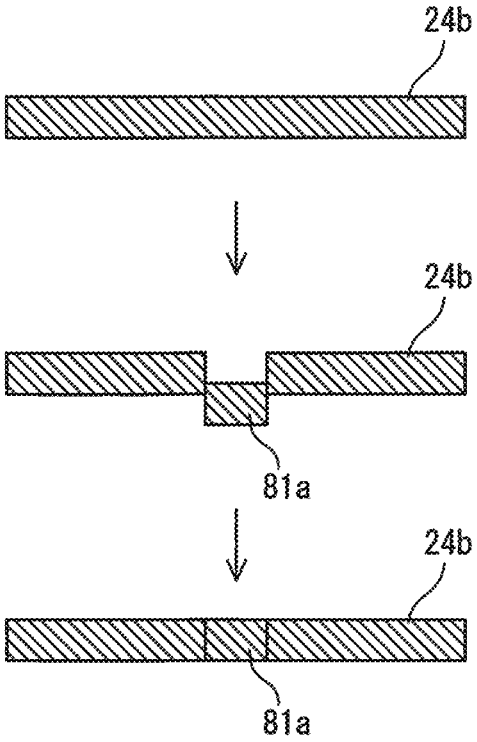
FIG. 8A is a cross-sectional view detailing a magnetic plate according to another embodiment.
Figure 8B:
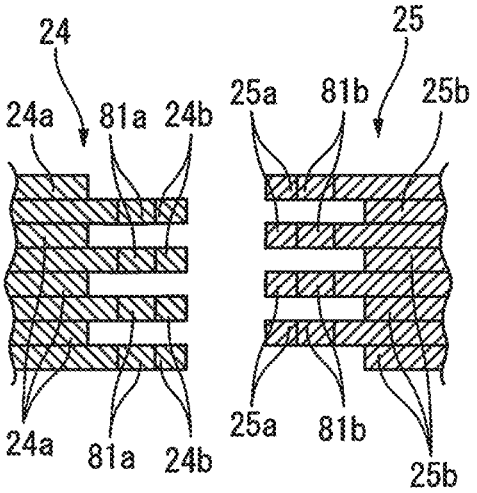
FIG. 8B is a vertical cross-sectional view of the outer peripheral iron core portions according to the other embodiment.
Figure 8C:
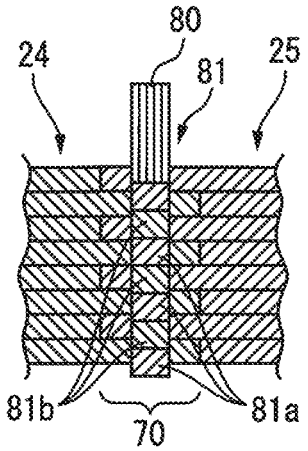
FIG. 8C is another vertical cross-sectional view taken along line A'-A' of FIG. 6.

FIG. 8A is a cross-sectional view detailing a magnetic plate according to another embodiment, FIG. 8B is a vertical cross-sectional view of the outer peripheral iron core portions according to the other embodiment, and FIG. 8C is another vertical cross-sectional view taken along line A'-A' of FIG. 6. As shown in FIG. 8A, the portion 81*a* of the magnetic plate 24*b* corresponding to the connection member 81 is incompletely punched. In other words, the portion 81*a* is created so as to not completely separate from the magnetic plate 24*b*. The portion 81*a* is again pushed back into the magnetic plate 24*b*, and as a result, a semi-withdrawn portion 81*a* is formed.

As shown in FIG. 8B, similar semi-withdrawn portions 81*b* are formed in the magnetic plates 25*a*. The outer peripheral iron core portions 24 and 25 described above are formed by stacking the magnetic plates 24*a* and 24*b* and stacking the magnetic plates 25*a* and 25*b*, respectively.

Thereafter, by forming the intermeshing portion 70 as shown in FIG. 8C, the semi-withdrawn portions 81, 81*b* are aligned in a row. The connection member 81 may be formed by pressing the semi-withdrawn portions 81*a*, 81*b* using a pressing member 80. In this case, since it is not necessary to create the connection member 81 in advance, it can be understood that the connection member can be formed more easily.

Figure 9:
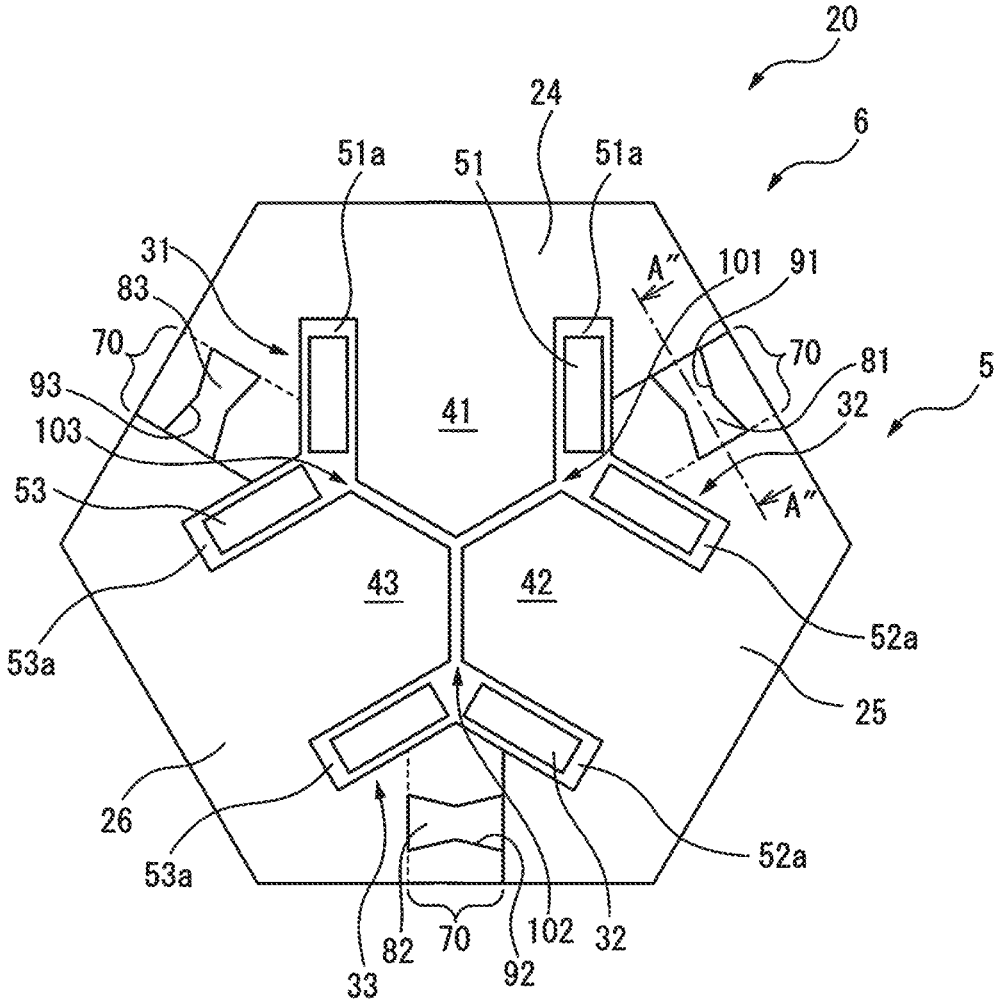
FIG. 9 is a cross-sectional view of the core reactor according to a third embodiment.

FIG. 9 is a cross-sectional view of the core body of a reactor according to a third embodiment. In the third embodiment, the connection parts 70 include through-holes 91 to 93 formed in the intermeshing portions 70 and connection members 81 to 83 which are inserted into and fitted in the through-holes 91 to 93.

Figure 10A:
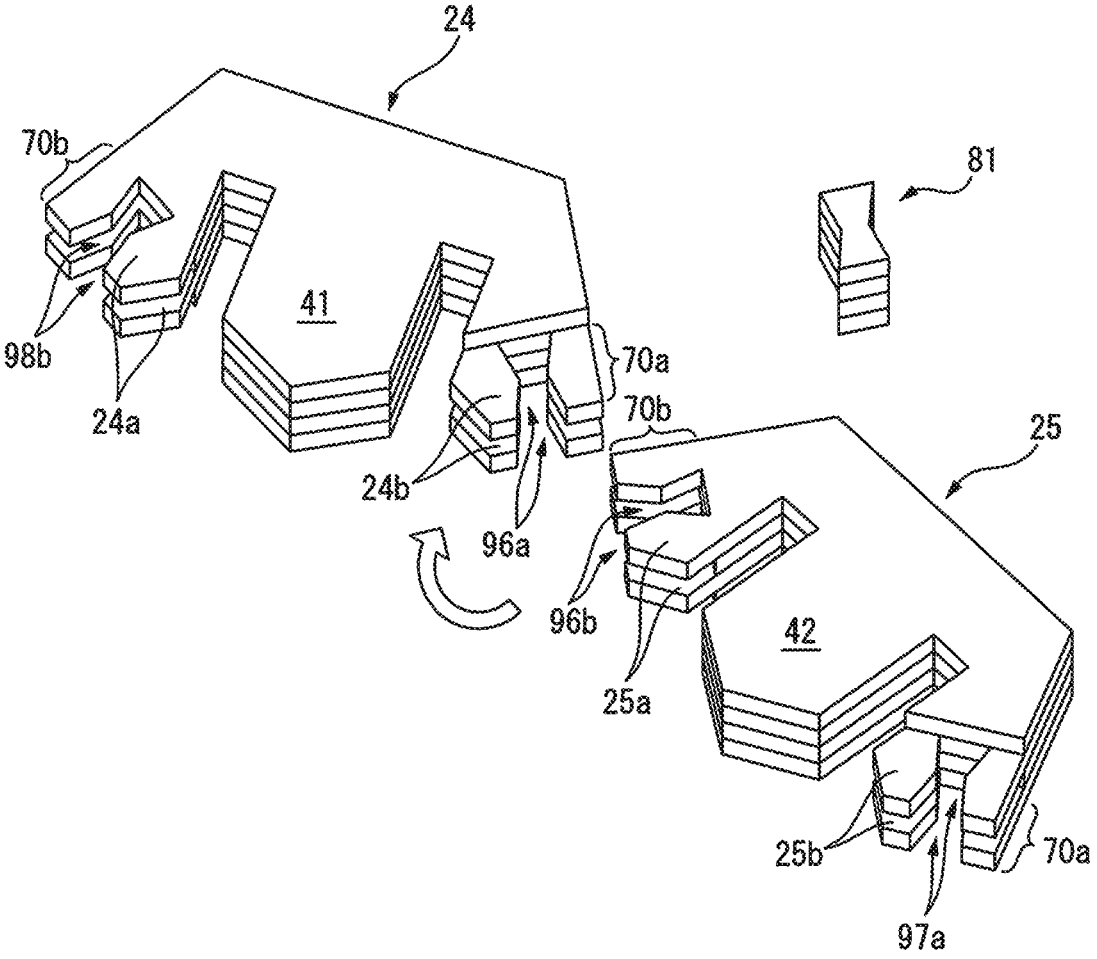
FIG. 10A is a partially exploded perspective view of the core body shown in FIG. 9.
Figure 10B:
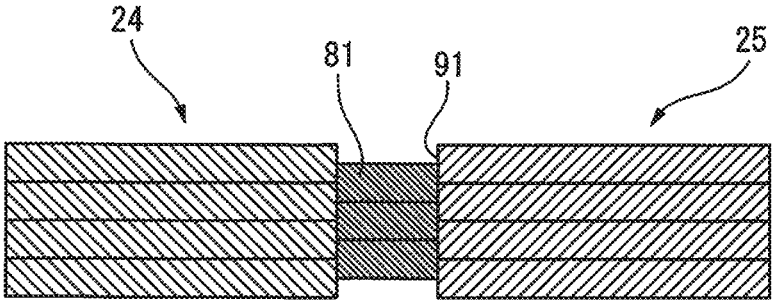
FIG. 10B is a vertical cross-sectional view taken along line A"-A" of FIG. 9.

Further, FIG. 10A is a partially exploded perspective view of the core body shown in FIG. 9 and FIG. 10B is a vertical cross-sectional view taken along line A"-A" of FIG. 9. As shown in FIG. 10A, recess parts 98*b* are formed in the projecting portions 70*b* of the magnetic plates 24*a* of the outer peripheral iron core portion 24 and recess parts 96*a* are formed in the projecting portions 70*a* of the magnetic plates 24*b*. Likewise, recess parts 96*b* are formed in the projecting portions 70*b* of the magnetic plates 25*a* of the outer peripheral iron core portion 25 and recess parts 97*a* are formed in the projecting portions 70*a* of the magnetic plates 25*b*. The sizes of the recess parts 96*a*, 96*b*, 97*a*, and 98*b* are equal to each other.

In the third embodiment, by forming the intermeshing portions 70 as described above, the through-hole 91 is formed from the recess parts 96*a* and 96*b*. The connection member 81, which is the same as described above, is inserted into and fitted in the through-hole 91. The same is true for the other through-holes 92 and 93. In this case, the outer peripheral iron core portion 24 and the outer peripheral iron core portion 25 can be more firmly fastened. Further, in the third embodiment, it can be understood that the same effects as described above can be obtained. Note that the shapes of the recess parts 96*a*, 96*b* are not limited to those described above.

Alternatively, it is preferable that the portions corresponding to the connection members 81 to 83 be punched from a plurality of stacked magnetic plates to thereby form the connection members 81 to 83. The portions corresponding to the outer peripheral iron core portions 24 to 26 integrally formed with the iron cores 41 to 43 may be punched from the stacked magnetic plates. In this case, it is not necessary to prepare additional members in order to form the connection members 81 to 83. However, the connection members 81 to 83 may be separately formed as single members.

Furthermore, when the connection members 81 to 83 are formed from a plurality of magnetic plates, the connection members 81 to 83 are magnetic materials. In contrast thereto, when the connection members are formed from a non-magnetic material, the magnetic properties of the reactor 6 at the locations of the connection members are influenced by the connection members, whereby magnetic flux saturation is promoted. However, when the connection members 81 to 83 are formed from a magnetic material, such a problem can be avoided.

As shown in FIG. 10B, the connection member 81 is shifted in the stacking direction by a distance smaller than the thickness of one of the magnetic plates. In other words, one of the magnetic plates of the connection member 81 contacts two of the plurality of magnetic plates constituting the outer peripheral iron core portion 24 and two of the plurality of magnetic plates constituting the outer peripheral iron core portion 25. The aforementioned distance is preferably half the thickness of one magnetic plate. In this case, the outer peripheral iron core portions 24 and 25 can be firmly connected with a simple structure. The same is true for the embodiment shown in FIG. 8C.

As shown in FIG. 10B, the number of the magnetic plates of the connection member 81 is preferably smaller than the number of the magnetic plates constituting the outer peripheral iron core portion 24 and the outer peripheral iron core portion 25. As a result, it is possible to prevent the end surfaces of the connection member 81 from protruding from the end surfaces of the outer peripheral iron core portions 24 and 25.

Figure 11:
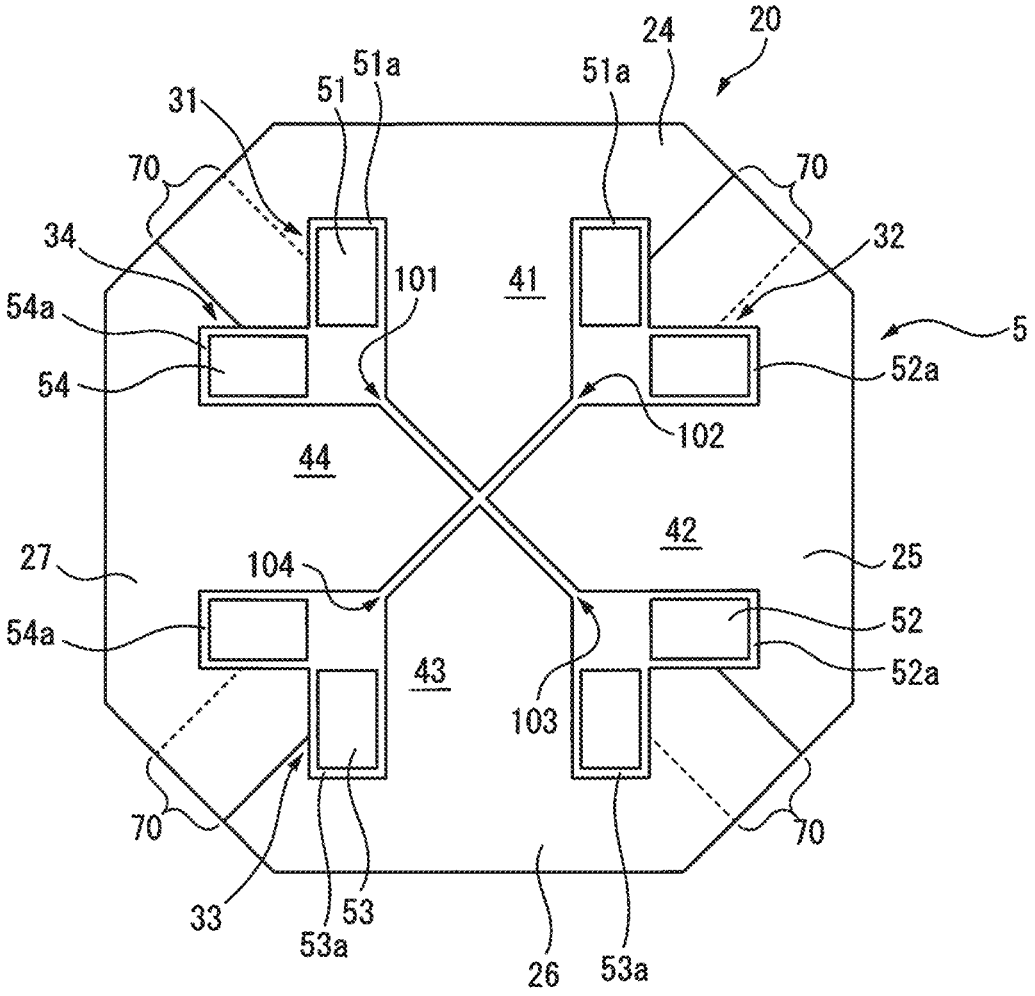
FIG. 11 is a cross-sectional view of a reactor according to a fourth embodiment.

FIG. 11 is a cross-sectional view of a reactor according to a fourth embodiment. The core body 5 of the reactor 6 shown in FIG. 11 includes a substantially octagonal outer peripheral iron core 20 composed of the outer peripheral iron core portions 24 to 26 and four iron core coils 31 to 34, which are the same as the aforementioned iron core coils. These iron core coils 31 to 34 are arranged at substantially equal intervals in the circumferential direction of the reactor 6. Furthermore, the number of the iron cores is preferably an even number of 4 or more, so that the reactor 6 can be used as a single-phase reactor.

As can be understood from the drawing, the iron core coils 31 to 34 include iron cores 41 to 44 extending in the radial directions and coils 51 to 54 wound onto the respective iron cores, respectively. The radially outer ends of the iron cores 41 to 44 are integrally formed with the respective outer peripheral iron core portions 24 to 27.

Further, each of the radially inner ends of the iron cores 41 to 44 is located near the center of the outer peripheral iron core 20. In FIG. 11, the radially inner ends of the iron cores 41 to 44 converge toward the center of the outer peripheral iron core 20, and the tip angles thereof are about 90 degrees. The radially inner ends of the iron cores 41 to 44 are separated from each other via the gaps 101 to 104, through which magnetic connection can be established.

In FIG. 11, intermeshing portions 70 are formed in the connecting surfaces of the outer peripheral iron core portions 24 to 27 as connection parts. The intermeshing portions 70 are the same as those described above, and the through-holes 91 to 94 into which the connection members are inserted may be formed in the intermeshing portions 70. Thus, in the fourth embodiment, it can be understood that the same effects as described above can be obtained.

Aspects of the Disclosure

According to the first aspect, there is provided a reactor (6), comprising an outer peripheral iron core (20) composed of a plurality of outer peripheral iron core portions (24 to 27), and at least three iron core coils (31 to 34) arranged inside the outer peripheral iron core, wherein the at least three iron core coils are composed of iron cores (41 to 44) coupled with the respective outer peripheral iron core portions and coils (51 to 54) wound onto the respective iron cores, and gaps (101 to 104), which can be magnetically coupled, are formed between one of the at least three iron cores and another iron core adjacent thereto, the reactor further comprising connection parts (70) for connecting the plurality of outer peripheral iron core portions to each other.

According to the second aspect, in the first aspect, the outer peripheral iron core portions and the iron core are formed by stacking a plurality of plates in a stacking direction.

According to the third aspect, in the first or second aspect, the connection parts include intermeshing portions (70) in which a plurality of plates of one outer peripheral iron core portion and a plurality of plates of another outer peripheral iron core portion project in a staggered manner and intermesh with each other between the outer peripheral iron core portions which are adjacent to each other.

According to the fourth aspect, in the third aspect, holes (91 to 94) are formed between the plurality of outer peripheral iron core portions or in the intermeshing portions, and the connection parts further include connection members (81 to 84) which are inserted into the holes.

According to the fifth aspect, in the fourth aspect, the connection members are formed by stacking a plurality of plates in the stacking direction, and the connection members are shifted with respect to the plurality of plates constituting the plurality of outer peripheral iron core portions in the stacking direction by a distance smaller than the thickness of one of the plurality of plates.

According to the sixth aspect, in the fourth or fifth aspect, the connection members are formed from a magnetic material.

According to the seventh aspect, in any one of the first through sixth aspects, the number of the at least three iron core coils is a multiple of three.

According to the eighth aspect, in any of the first through sixth aspects, the number of the at least three iron core coils is an even number not less than four.

Effects of the Aspects

In the first aspect, since the plurality of outer peripheral iron core portions are connected by the connection parts, it is possible to prevent the plurality of outer peripheral iron core portions from becoming misaligned due to magnetostriction.

In the second aspect, the outer peripheral iron core portions and the iron cores can be easily assembled.

In the third aspect, the plurality of outer peripheral iron core portions can be easily connected by the intermeshing portions. Furthermore, disassembly and reassembly of the reactor is easy.

In the fourth aspect, by using connection members, since the connection members are inserted into the holes, the plurality of outer peripheral iron core portions can be firmly connected, and it is possible to prevent the size of the reactor from increasing.

In the fifth aspect, since the connection members are shifted in the stacking direction, the plurality of outer peripheral iron core portions can be firmly connected to each other with a simple configuration. Furthermore, since the connection members and the plurality of outer peripheral iron core portions can be produced by punching a plurality of stacked plates, it is not necessary to prepare additional members in order to produce the connection members.

When the connection members are made from a non-magnetic material, the magnetic properties of the reactor at the locations of the connection members tend to be influenced by the connection members, thus resulting in the occurrence of magnetic flux saturation. In the sixth aspect, since the connection members are formed from a magnetic material, such a problem can be avoided.

In the seventh aspect, the reactor can be used as a three-phase reactor.

In the eighth aspect, the reactor can be used as a single-phase reactor.

Though the present invention has been described using representative embodiments, a person skilled in the art would understand that the foregoing modifications and various other modifications, omissions, and additions can be made without departing from the scope of the present invention.

The invention claimed is:

1. A reactor, comprising an outer peripheral iron core composed of a plurality of outer peripheral iron core portions, and at least three iron core coils arranged inside the outer peripheral iron core, wherein the at least three iron core coils are composed of iron cores coupled with the respective outer peripheral iron core portions and coils wound onto the respective iron cores, and gaps, which can be magnetically coupled, are formed between one of the at least three iron cores and another iron core adjacent thereto, the reactor further comprising:

connection parts for connecting the plurality of outer peripheral iron core portions to each other, wherein the outer peripheral iron core portions and the iron core are formed by stacking a plurality of plates in a stacking direction, the connection parts include intermeshing portions in which a plurality of plates of one outer peripheral iron core portion and a plurality of plates of another outer peripheral iron core portion project in a staggered manner and intermesh with each other between the outer peripheral iron core portions which are adjacent to each other, the widths of the iron cores excluding radially inner ends of the iron cores are greater than a maximum width of the intermeshing portions in the radial direction of the outer peripheral iron core over the entirety of the lengths of the iron cores in the radial direction of the outer peripheral iron core, and the maximum widths of the intermeshing portions in the radial direction of the outer peripheral iron core when magnetic flux passes in the vicinity of the connection parts are greater than the widths of other portions of the outer peripheral core.

2. The reactor according to claim 1, wherein the intermeshing portions are formed on a portion of the outer peripheral iron core located between two adjacent coils.

3. A reactor, comprising an outer peripheral iron core composed of a plurality of outer peripheral iron core portions, and at least three iron core coils arranged inside the outer peripheral iron core, wherein the at least three iron core coils are composed of iron cores coupled with the respective outer peripheral iron core portions and coils wound onto the respective iron cores, and gaps, which can be magnetically coupled, are formed between one of the at least three iron cores and another iron core adjacent thereto, the reactor further comprising:

connection parts for connecting the plurality of outer peripheral iron core portions to each other, wherein the outer peripheral iron core portions and the iron core are formed by stacking a plurality of plates in a stacking direction, the connection parts include intermeshing portions in which a plurality of plates of one outer peripheral iron core portion and a plurality of plates of another outer peripheral iron core portion project in a staggered manner and intermesh with each other between the outer peripheral iron core portions which are adjacent to each other, semi-withdrawn portions are formed in the connection parts of a plurality of plates of one outer peripheral iron core portion and a plurality of plates of another outer peripheral iron core portion by incompletely punching the plurality of plates and pushing back the incompletely punched portion so as to reshape the plurality of plates, and the connection parts include connection members which are formed by pressing the semi-withdrawn portions, which are aligned in a row, at the intermeshing portions.

4. A reactor, comprising an outer peripheral iron core composed of a plurality of outer peripheral iron core portions, and at least three iron core coils arranged inside the outer peripheral iron core, wherein the at least three iron core coils are composed of iron cores coupled with the respective outer peripheral iron core portions and coils wound onto the respective iron cores, and gaps, which can be magnetically coupled, are formed between one of the at least three iron cores and another iron core adjacent thereto, the reactor further comprising:

connection parts for connecting the plurality of outer peripheral iron core portions to each other, wherein the outer peripheral iron core portions and the iron core are formed by stacking a plurality of plates in a stacking direction, the connection parts include intermeshing portions in which a plurality of plates of one outer peripheral iron core portion and a plurality of plates of another outer peripheral iron core portion project in a staggered manner and intermesh with each other between the outer peripheral iron core portions which are adjacent to each other, holes are formed between the plurality of outer peripheral iron core portions or in the intermeshing portions, the connection parts further include connection members which are inserted into the holes, the connection members are formed by stacking a plurality of plates in the stacking direction, and the connection members are shifted with respect to the plurality of plates constituting the plurality of outer peripheral iron core portions in the stacking direction by a distance smaller than the thickness of one of the plurality of plates.

5. The reactor according to claim 1, wherein holes are formed between the plurality of outer peripheral iron core portions or in the intermeshing portions, and the connection parts further include connection members which are inserted into the holes.

6. The reactor according to claim 5, wherein the connection members are formed by stacking a plurality of plates in the stacking direction, and the connection members are shifted with respect to the plurality of plates constituting the plurality of outer peripheral iron core portions in the stacking direction by a distance smaller than the thickness of one of the plurality of plates.

7. The reactor according to claim 5, wherein the connection members are formed from a magnetic material.

8. The reactor according to claim 1, wherein the number of the at least three iron core coils is a multiple of three.

9. The reactor according to claim 1, wherein the number of the at least three iron core coils is an even number not less than four.

* * * * *